US005828185A

United States Patent [19]

Fellows et al.

[11] Patent Number: 5,828,185

[45] Date of Patent: Oct. 27, 1998

[54] HIGH FREQUENCY HID LAMP SYSTEM WITH LAMP DRIVEN AT A FREQUENCY ABOVE THE AUDIBLE AND BELOW THE LOWEST LAMP RESONANT FREQUENCY

[75] Inventors: Mark Fellows, New Fairfield, Conn.; Gregory Nelson, Painted Post, N.Y.; Robertus A. J. Keyser, Veldhoven, Netherlands; Dale E. Work, Flemington, N.J.; Josephus C. M. Hendricx, Herersveld, Netherlands; Oscar J. Deurloo, Veldhoven, Netherlands; Aswin J. G. Linden, Weert, Netherlands; Peter A. Seinen, Veldhoven, Netherlands; Andrew Jackson, Hammondsport, N.Y.

[73] Assignee: Philips Electronics North America Corporation, New York, N.Y.

[21] Appl. No.: 647,384

[22] Filed: May 9, 1996

[51] Int. Cl.[6] ..... H05B 37/02

[52] U.S. Cl. ..... 315/246; 315/209 R; 315/291; 313/318.01; 313/623

[58] Field of Search ..... 315/246, 247, 315/291, 307, 308, 209 R, 224, 219; 313/318.01, 318.02, 318.03, 318.04, 623, 624, 625, 266, 637, 638

[56] References Cited

U.S. PATENT DOCUMENTS

| | | | |
|---|---|---|---|
| 4,463,286 | 7/1984 | Justice | 315/219 |
| 4,484,108 | 11/1984 | Stupp et al. | 315/219 |
| 4,490,649 | 12/1984 | Wang | 315/50 |
| 5,121,034 | 6/1992 | Allen et al. | 315/246 |
| 5,357,173 | 10/1994 | Kachmarik et al. | 315/209 R |
| 5,424,609 | 6/1995 | Geven et al. | 313/623 |
| 5,436,533 | 7/1995 | Fromm et al. | 315/246 |
| 5,491,386 | 2/1996 | Eriguchi et al. | 315/209 R |
| 5,568,009 | 10/1996 | Gandhi | 313/318.01 |
| 5,680,015 | 10/1997 | Bernitz et al. | 315/291 |

OTHER PUBLICATIONS

An Autotracking System for Stable Hf Operation of HID Lamps, F. Bernitz, Symp. Light Sources, Karlsruhe, 1986.

U.S. Appln. Serial No. 08/366, 135, filed Dec. 29, 1994.

*Primary Examiner*—Robert J. Pascal
*Assistant Examiner*—David H. Vu
*Attorney, Agent, or Firm*—Brian J. Wieghaus

[57] ABSTRACT

A high pressure gas discharge lamp system includes a high pressure discharge lamp selected to have a lowest lamp resonant frequency above the audible, on a current basis above about 19 kHz and on a power basis of above about 38 kHz. The ballast circuit energizes the discharge device so as to have a fundamental frequency below the lowest lamp resonant frequency and above the audible, while keeping the magnitude of any harmonics above the lowest lamp resonant frequency sufficiently small so as to avoid acoustic resonance. By operating below the lowest lamp resonant frequency, greatly simplifying ballast construction and cost. According to one embodiment, the discharge vessel encloses a discharge space which is circular cylindrical and having a L:ID ratio of about 1:1 to maximize the lowest lamp resonant frequency. According to another embodiment, two or more discharge devices are operated concurrently by the ballast, each having a lowest lamp resonant frequency of above the audible, and the ballast operating frequency so as to increase light output while still avoiding acoustic resonance.

23 Claims, 9 Drawing Sheets

HIGH FREQUENCY HID LAMP SYSTEM WITH LAMP DRIVEN AT A FREQUENCY ABOVE THE AUDIBLE AND BELOW THE LOWEST LAMP RESONANT FREQUENCY

CROSS REFERENCE TO RELATED APPLICATIONS

This application relates to U.S. application Ser. No. 647,385, filed concurrently herewith entitled "Integrated HID Reflector Lamp" of Dale Work et al which discloses and claims a reflector lamp with an HID arc tube integrated in one embodiment with a high frequency ballast and avoiding acoustic resonance.

BACKGROUND OF THE INVENTION

The invention relates to a high frequency, high pressure gas discharge lamp system including

- a high pressure gas discharge lamp with a discharge vessel sealed in a gas-tight manner and enclosing a discharge space, a discharge sustaining filling, and means for maintaining a discharge within said discharge space during lamp operation; and
- a ballast circuit coupleable to the discharge lamp for energizing the discharge lamp to maintain a gas discharge within the discharge space during lamp operation.

Such a system is known from the article "An Autotracking System For Stable Hf Operation of HID Lamps", F. Bernitz, Symp. Light Sources, Karlsruhe 1986.

Gas discharge lamps have traditionally been operated with low frequency magnetic ballasts. High frequency ballasts are becoming increasingly popular for low pressure mercury vapor fluorescent lamps. For fluorescent lamps, high frequency operation significantly improves lamp efficacy and permits the magnetic elements of the ballast to be greatly reduced in size and weight compared to conventional magnetic ballasts. Similar reduction in size and weight would be desirable for HID lamps, especially for lower wattage metal halide lamps used for shop and track lighting, because it would provide greater flexibility in designing aesthetically pleasing fixtures for such uses. System efficiency would also increase a few percent, though not nearly as much as for fluorescent lamps, due to lower ballast losses.

A major obstacle to the use of high frequency electronic ballasts for HID lamps, however, is the acoustic resonances/arc instabilities which can occur at high frequency operation. Acoustic resonances, at the minimum, can cause flicker of the arc which is very annoying to humans. In the worst case, acoustic resonance can cause the discharge arc to extinguish, or even stay permanently deflected against and damage the wall of the discharge vessel, which may cause the discharge vessel to rupture.

The above-cited article discloses a ballast which continuously varies the lamp operating frequency about a center frequency over a sweep range. The sweep frequency is the frequency at which the operating frequency is repeated through the sweep range. The ballast senses lamp voltage to evaluate arc instabilities. A control signal is derived from the sensed lamp voltage to vary the sweep frequency between 100 Hz and some kHz to achieve stable operation. However, this system has never been commercialized.

A disadvantage of such a system is that changing the operating frequency and/or sweeping the operating frequency over a range of operating frequencies requires additional control components for these functions which increases the size and cost of the ballast. Additionally, these changes would change the lamp power, requiring still further control mechanisms, for example adjusting the DC-supply voltage or the current limiting inductance, to maintain the desired power.

SUMMARY OF THE INVENTION

Accordingly, it is an object of the invention to overcome the above-mentioned disadvantages of the known system. This object is accomplished in that a system of the type defined in the opening paragraph is characterized in that:

- the discharge lamp during normal lamp operation is free of acoustic resonances at alternating lamp currents below a lowest lamp resonant frequency,
- the ballast circuit energizes the discharge lamp so as to have an alternating lamp current having a fundamental frequency and harmonics which are integral multiples of the fundamental frequency,
- the lowest lamp resonant frequency is greater than about 19 kHz, the fundamental frequency is maintained during nominal lamp operation in a window only between (ii) about 19 kHz and (ii) the lowest lamp resonant frequency and
- the harmonics above the lowest lamp resonant frequency have amplitudes which are insufficient to induce acoustic resonance.

The frequencies at which acoustic resonance occurs depend on many factors, including the dimensions of the discharge vessel (i.e., length, diameter, end chamber shape, the presence or absence of a tubulation), the density of the gas fill, operating temperature and lamp orientation. As used herein "acoustic resonance" is meant that level of resonance which causes disturbances of the discharge arc visible to the human eye. With prior art systems known inter alia from the above-cited Berlitz article, the discharge devices had acoustic resonance occurring at low and midrange frequencies (for example, 100–500 Hz and 5000–7000 Hz) as well as at high frequencies above about 19 kHz. The discharge devices were of quartz and frequently had only limited, narrow operating windows bounded at the low and high end by frequencies at which acoustic resonance occurs. Furthermore, the discharge vessels were of quartz glass, for which tight dimensional control is difficult in high speed manufacturing. Consequently, even for discharge devices of the same type and wattage, the system designer was faced with narrow operating windows which would be different not only for lamps from different manufacturers, but also from lamp to lamp for the same manufacturer.

The invention is based on the discovery that discharge devices with carefully selected dimensions can have their lowest resonant frequency, on a lamp current basis, at a frequency substantially higher than the audible frequency of about 19 kHz, for example at 30 to 40 kHz. In contrast to the prior art systems, such a lamp has a wide operating window extending not only from 0 Hz up to the lowest resonant frequency but also a wide operating window between about 19 kHz and the lowest lamp resonant frequency, at which the ballast can operate.

It should be noted that acoustic resonance is technically induced by the lamp power, i.e., the product of the lamp current and lamp voltage. As such, acoustic resonances can be defined in terms of power frequencies, which are generally twice the lamp current frequencies since the lamp current and voltage are typically closely in phase for most high frequency ballasts. However, the corresponding lamp current frequency at which acoustic resonance occurs for a given discharge device operated on a given ballast is readily identifiable. Accordingly, the acoustic resonance frequencies will be stated herein in terms of lamp current frequencies and lamp power frequencies, and where only one is given, the other can be readily determined from the 1:2 relationship given above.

The invention is also based on the recognition that acoustic resonance can be induced not only by the fundamental driving frequency but also by harmonics of the output current (or power) of the typical electronic ballast. Even if the fundamental frequency is well below the lowest resonant frequency of the lamp, acoustic resonance could still be induced by harmonics with sufficient amplitude above the lowest lamp resonant frequency. Consequently, for resonance free operation, the ballast must have a driving signal in which any harmonics above the lowest lamp resonant frequency are sufficiently small so as not to induce acoustic resonance.

According to a very favorable embodiment, the ballast maintains the fundamental frequency substantially constant during lamp operation. This feature avoids many of the control components of the prior art systems associated with changing and sweeping the frequency and maintaining constant power, thereby reducing cost and physical size of the ballast.

Favorably, the discharge vessel comprises a ceramic wall The term "ceramic wall" is here understood to mean a wall of a refractory material such as monocrystalline metal oxide (for example, sapphire), polycrystalline metal oxide (for example, polycrystalline densely sintered aluminum oxide; yttrium-aluminum garnet, or yttrium oxide), and polycrystalline non-oxidic material (for example, aluminum nitride). Such materials allow for high wall temperatures up to 1400–1600 K and are satisfactorily resistant to chemical attacks by halides, halogens and by Na. This has the advantage that the dimensional tolerances for discharge vessels of ceramic material are much smaller than those for conventional pressed quartz glass technology. The lower tolerances enable, on a lamp-to-lamp basis, much greater uniformity with respect to acoustic resonance characteristics as well as colorimetric properties.

According to another embodiment, the discharge device includes a central cylindrical zone with end walls. The end walls being spaced by an axial distance "L" and the central zone having an inner diameter "ID", and the ratio L:ID is about 1:1. Lamps having a ceramic discharge vessel with such a central zone are known, for example, from U.S. Pat. No. 5,424,609 (Gevens et al). However, in the disclosed lamp, the central zone is longer and narrower than 1:1, having an L:ID ratio of about 4:3 or greater. The inventors have found that ratios of about 1:1 yield a maximum in the lowest lamp resonant frequency. At this ratio, the first acoustic resonance for the longitudinal direction (controlled by the dimension L) substantially coincides with the first acoustic resonance for the radial and azimuthal directions (controlled by the dimension ID) Generally, as the ratio moves away from 1:1, the larger dimension will lower the frequency at which acoustic resonance occurs for the respective radial/azimuthal or longitudinal modes, thereby being determinative of the lowest lamp resonant frequency.

According to a very favorable embodiment, the system includes a plurality of discharge vessels each having a lowest resonant frequency (on a current basis) above about 19 kHz and energized by the ballast to concurrently emit light. The present inventors are unaware of any practical discharge devices in quartz glass which have their lowest resonant frequency on a current basis above about 19 kHz. Furthermore, even with a ceramic discharge vessel having an L:ID ratio of about 1:1 discussed above, the maximum rated wattage for such a discharge device having a lowest resonant frequency above 19 kHz (on a current basis) is expected by the inventors to be about 35 Watts. This embodiment is significant for providing relatively high light output yet which can be operated above about 19 kHz without acoustic resonance.

Favorably, the multiple discharge devices are enclosed in a common lamp outer envelope. The discharge devices may be electrically connected in series. Connecting the discharge devices in series ensures that each device has the same lamp current.

These and other aspects, features and advantages of the invention will become apparent with reference to the drawings and the following detailed description.

BRIEF DESCRIPTION OF THE DRAWINGS

FIG. 5(*b*) illustrates a recurrent start feature;

FIG. 6(*b*) illustrates the harmonics in the lamp current;

FIG. 6(*c*) illustrates the harmonics in the lamp voltage;

FIG. 6(*d*) illustrates the harmonics in the lamp power;

DESCRIPTION OF THE PREFERRED EMBODIMENTS

Figure 1:
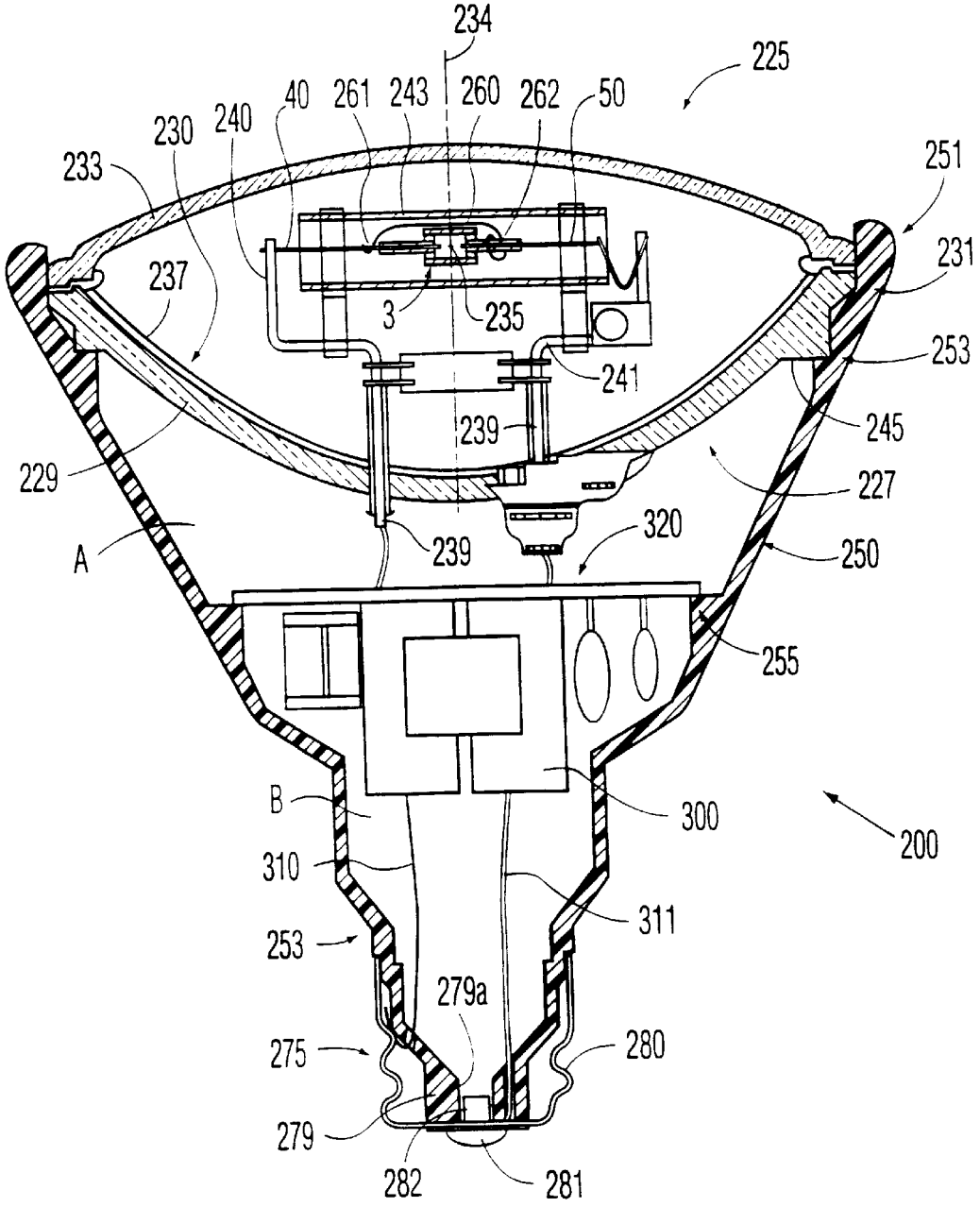
FIG. 1 shows a lamp system according to the invention in the form of an integrated HID reflector lamp having a unitary structure including a sealed reflector unit, a ballast and a shell enclosing the ballast and holding the lamp reflector unit.

FIG. 1 shows an integrated reflector lamp 200 having a sealed reflector unit 225 received in a shell 250 enclosing a ballast 300. The reflector unit has a glass lamp envelope 227 sealed in a gas-tight manner and enclosing a high pressure discharge device 3.

The lamp envelope 227 includes a pressed glass reflector body with a basal portion 229 and a parabolic surface 230 which extends to a rim 231 of the reflector body. (FIG. 1) A cover in the form of a pressed glass lens 233 is hermetically sealed to the reflector body at the rim 231. The parabolic surface 230 has an optical axis 234 with a focus 235 on the optical axis and has a reflective coating 237 thereon, such as aluminum. Other suitable materials for the reflective coating include silver and multi-layer dichroic coatings. The basal portion of the reflector body includes ferrules 239 through which conductive supports 240, 241 extend in a gas-tight manner. The conductive supports are connected to respective feed-throughs 40, 50 of the discharge device 3. The conductive supports also support a light transmissive sleeve 243 around the discharge device 3. The envelope 227 has a filling of gas which in the absence of a properly sized sleeve would support convection currents during lamp operation. The light transmissive sleeve 243 provides thermal regulation by controlling convective cooling of the discharge device 3.

The shell 250 is molded from a synthetic resin material which withstands the operating temperatures reached by the sealed reflector unit and the ballast. Suitable materials include PBT, polycarbonate, polyethermide, polysulphine and polyphenylsulphine. The shell has a rim portion 251 which holds the outer surface of the rim 231 of the sealed reflector unit and provides a shoulder by which the lamp 200 can be secured in a standard PAR fixture. A circumferential shoulder 253 provides a seat for a corresponding flange 245 of the reflector body. The sealed reflector unit is secured by the rim 251 with a snap fit axially against the shoulder 253. Opposite the rim portion, the shell has a basal portion which receives a screw base 275. The screw base includes an outer threaded metal contact 280 and a center contact 281. The screw base is an Edison type base and is received in an ordinary threaded Edison socket. The screw base has a solderless connection with the input leads 310, 311 from the ballast 300. The lead 310 is clamped between the body 279 and the threaded contact 280. The lead 311 is clamped between a bore wall 279*a* of the body 279 and a shank 282 of the center contact 281. (A full description of the solderless connection is known from U.S. application Ser. No. 08/366,135 filed Dec. 29, 1994 of Harish Gandhi entitled "Electric Lamp having a lamp cap with solder free connections", now U.S. Pat. No. 5,568,009) The shell includes a further shoulder 255 which supports a circuit board 320 of the ballast. The shoulder 255 includes tabs (not shown) which extend through respective holes in the circuit board. The tabs have end portions which are pressed against the circuit board, by plastic welding for example, to hold the circuit board against the shoulder.

The sleeve 243 and/or the lens 225 may be constructed to block UV light emitted by the discharge device 3. The UV blocking function may be obtained through the use of UV blocking glass, such as glass with an addition of cerium or titanium, or a UV filter such as a dichroic coating. Such UV blocking glasses and filters are known in the art. The filter may also be applied to the wall of the discharge device 3.

Additionally, the color of the light emitted by the discharge device may be altered by color correcting materials for the ceramic discharge device 3, the sleeve 243 or the lens 225 or with color correcting filters, such as dichroic filters, on these components.

Figure 2:
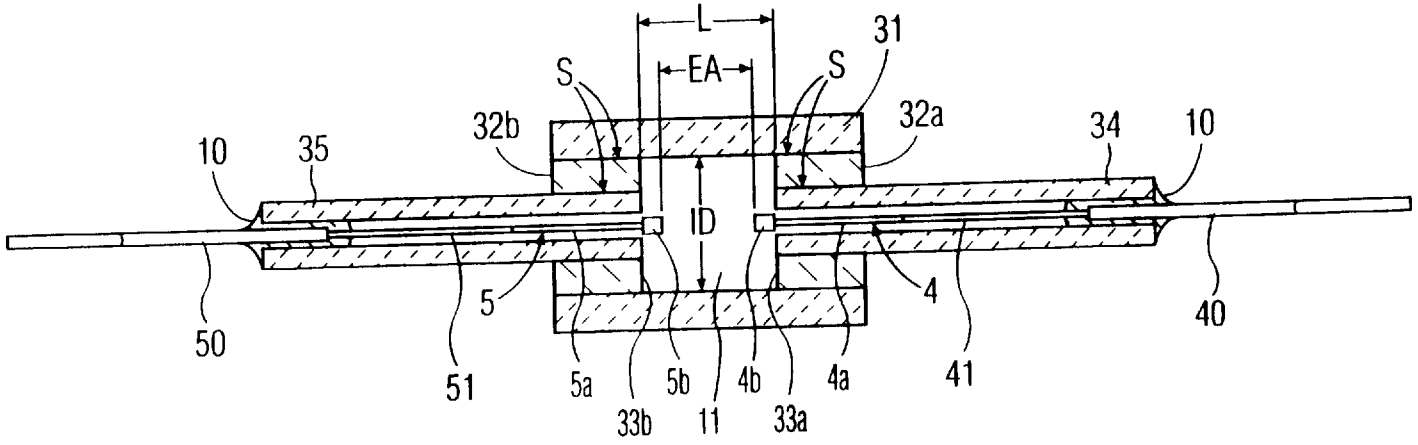
FIG. 2 shows the discharge vessel for the lamp of FIG. 1 in detail.

The discharge device 3 is shown in more detail in FIG. 2 (not true to scale). The discharge vessel is made of ceramic, i.e. it has ceramic walls. The discharge device has a central zone formed from a circular cylindrical wall 31 with an internal diameter "ID" closed off at either end by end wall portions 32*a*, 32*b*, each end wall portion 32*a*, 32*b* forming an end face 33*a*, 33*b* of the discharge space 11. The end wall portions each have an opening in which a ceramic closing plug 34, 35 is fastened in the end wall portion 32*a*, 32*b* in a gas tight manner by means of a sintered joint S. The ceramic closing plugs 34, 35 define opposing end zones of the discharge vessel and each narrowly enclose a lead-through 40, 41; 50, 51 of an associated electrode 4, 5 provided with a tip 4*b*, 5*b*. The lead-through is connected to the closing plug 34, 35 in a gas tight manner by means of a ceramic glazing joint 10 at its side facing away from the discharge space.

The electrode tips 4*b*, 5*b* are situated at a mutual distance "EA". The lead-throughs each comprise a halide-resistant portion 41, 51 made of, for example, a Mo—$Al_2O_3$ cermet, and a portion 40, 50 which is fastened to an associated closing plug 34, 35 in a gas tight manner by means of the ceramic glazing joint 10. The ceramic glazing joint extends over some distance, for example approximately 1 mm. The portions 40, 50 are made of a metal which has a coefficient of expansion which harmonizes very well with that of the closing plugs. For example, Nb is a very suitable material. The lead-through construction described renders it possible to operate the lamp in any burning position as desired.

Each electrode 4, 5 comprises an electrode rod 4*a*, 5*a* which is provided with a winding 4*c*, 5*c* near the tip 4*b*, 5*b*. The electrode tips lie adjacent the end faces 33*a*, 33*b* of the end wall portions. A further description of the discharge device and its closing plug structure is available from U.S. Pat. No. 5,442,609 (Gevens et al), herein incorporated by reference.

A starting aid 260 is secured to the discharge device 3 and consists of a length of wire which has one end 261 connected to the lead-through 40. Its other end 262 is a loop which extends around the opposing closing plug structure. In the area of the loop, the closing plug structure has a gap between the portion 51 and the inner wall of the closing plug 35 in which the starting and buffer gas is present. When an ignition pulse is applied across the lead-throughs 40,50, the leading edge of the starting pulse causes the starting and buffer gas in the area of the loop 262 to ionize. This ionization provides free electrons as well as UV light which generates further electrons that reduce the electric potential required for starting.

Acoustic Resonance Protection

An important feature of the lamp system according to the invention is the selection of the discharge device to have its lowest acoustic resonant frequency (on a lamp current basis) at a frequency substantially higher than the audible frequency of about 19 kHz. This provides a large frequency window in which the ballast can operate above the audible range but below the lowest lamp resonant frequency without the danger of inducing annoying flicker of the arc or arc displacements which lead to extinguishment or even failure of the discharge device 3.

In a practical embodiment, the lamp according to FIG. 1 was constructed as a retrofit lamp to replace PAR 38 lamps used in, for example, high hat fixtures for lighting commercial establishments, such as the public areas of shopping malls. The discharge device has a rated power of 20 W. The discharge vessel is made of polycrystalline aluminum oxide, has an internal diameter ID of 3.0 mm and an interspacing between the electrode tips "EA" of about 2.0 mm. The closing plugs 34, 35 were sintered in the end wall portions 32*a*, 32*b* substantially flush with the end faces 33*a*, 33*b* formed by the end wall portions. The electrodes have a tungsten rod 4*a*, 5*a* provided with a tungsten winding 4*b*, 5*b* at the tip. The distance between each electrode tip and the adjacent end face was about 0.5 mm. The ID was constant over the distance "L" of 3.0 mm between the end faces 33*a*, 33*b*.

The discharge vessel has a filling of 2.3 mg Hg and 3.5 mg NaI, $DyI_3$ and TlI in a mole ratio of 90:1.4:8.6. The discharge vessel also contains Ar as a starting and buffer gas. The interior of the sealed reflector envelope 227 has a gas fill of 75% krypton, with the balance $N_2$ at a pressure of 400 Torr. The sleeve 243 has a wall thickness of 1 mm and a clearance of 2 mm from the wall 31 of discharge device 3. In the disclosed embodiment, mercury is used as a buffer to set the arc voltage at a suitable level. Other buffers may be used such as zinc and xenon.

The discharge device was found to have a lowest resonant frequency of above 30 kHz (on a lamp current basis) during nominal lamp operation. There are two main groups of acoustic resonances, the first being in the longitudinal (axial) direction of the discharge vessel and the second being the azimuthal/radial resonances. It is desirable to have the lowest resonant frequency for each group to be about the same, since the lowest one determines the upper end of the operating window for the ballast. The fundamental longitudinal frequency is given by $f_{10}=C/(2*L)$ and the fundamental azimuthal/radial frequency is given by $f_{ar0}=1.84*C/(\pi*ID)$, where "L" and "ID" are the length and internal diameter of the discharge space as shown in FIG. 2 and "C" is the speed of sound. The speed of sound, however, is dependent on the temperature gradient of the gas in the discharge space, and has been found to be different for the longitudinal and radial/azimuthal modes. Based on experimentation, the inventors have found that the speed of sound is approximately 420 m/s for the longitudinal resonances and about 400 m/s for the azimuthal/radial resonances for a discharge vessel with the above-described fill. For the specific 3 mm×3 mm L:ID discharge vessel described above, $f_{10}\approx 70$ kHz and $f_{ar0}\approx 80$ kHz (on a power frequency basis). These correspond to 35 and 40 kHz, respectively, on a current basis and are regarded as being acceptably close together and substantially the same. However, to bring them closer together, the dimension ID can be made larger relative to the length L, which will lower the fundamental azimuthal/radial frequency towards that of the longitudinal fundamental resonant frequency. For the disclosed discharge device the dimensions L and ID should satisfy the relation $L \leqq D \leqq 1.2\ L$.

Furthermore, it should be noted that the insertion depth of the electrodes has little influence on the lowest acoustic resonance frequency, the insertion depth being only a 2nd to 3rd order influence.

Because of this relatively large frequency window between the lowest resonant frequency of the discharge device 3 and the audible frequency of 19 kHz, the ballast may have a constant current frequency during lamp operation, greatly simplifying its design and cost. As further described below, for the above described discharge device, the operating frequency for the fundamental of the lamp current is selected at a nominal 24 kHz. This provides a headroom of about 5 kHz with the lowest resonant frequency of 30 kHz of the discharge device. Thus, the fundamental operating frequency is between the lowest lamp resonant frequency and 19 kHz. Still a further aspect relates to controlling the amplitude of higher harmonics of the fundamental frequency, to prevent acoustic resonance by such higher harmonics. This aspect will be further discussed in the following description of the ballast.

The Ballast

Figure 3:
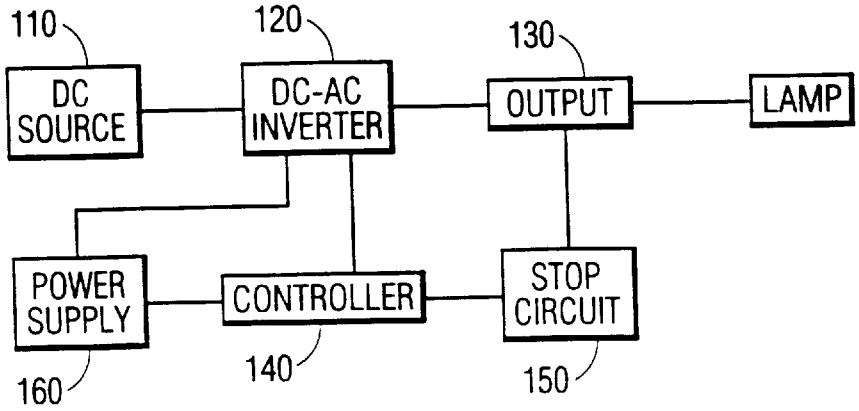
FIG. 3 is a block diagram of a high frequency ballast for operating the lamp of FIG. 1.

FIG. 3 shows a block diagram of a high frequency lamp ballast for operating the lamp of FIG. 1. The ballast has a DC source 110 providing a DC input to DC-AC inverter 120. A resonant output circuit 130 includes the discharge device 3 of FIG. 1 and is coupled to the DC-AC inverter. A control circuit 140 controls the inverter 120 to ignite the lamp and to operate the lamp after ignition with a substantially constant lamp current frequency above about 19 kHz and below the lowest lamp resonant frequency. The ballast includes a soft start circuit for generating a gradual increase in the ignition voltage. A low voltage power supply 160 provides power to operate the control circuit upon circuit startup prior to oscillation of the inverter as well as during inverter oscillation. A stop circuit 150 senses when the discharge device 3 has extinguished, turns off the inverter stage and turns it back on to provide a pulsing start to allow reignition of the discharge device 3. The ignition pulses are provided for a nominal 50 ms, with a pulse repetition frequency of a nominal 400 ms.

Figure 4:
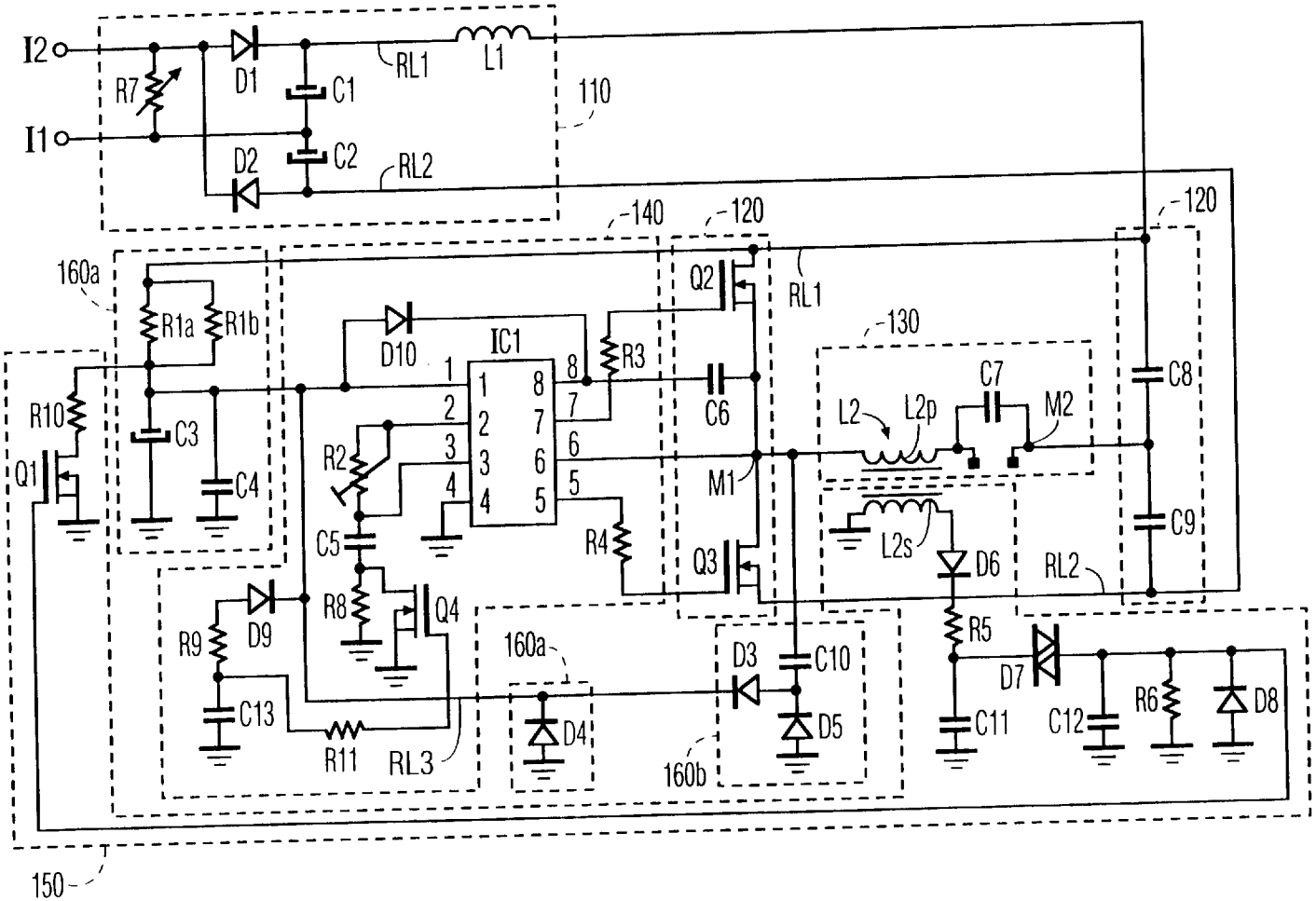
FIG. 4 is a circuit diagram of the high frequency ballast of FIG. 3.

As shown in FIG. 4, the DC source 110 includes a pair of input terminals I1, I2 for receiving a standard AC power line voltage of 110–120 V. A varistor R7 connected across the input terminals I1, I2 provides protection for the circuit against transients. A voltage doubler includes the diodes D1, D2 and the capacitors C1, C2. The voltage doubler provides a 120 Hz DC output of about 300 V on the DC rails RL1, RL2.

The inverter 120 is a half-bridge inverter with MOSFET switches Q2 and Q3 connected in totem pole fashion, i.e. connected in series across the DC rails RL1, RL2. The source of switch Q2 is connected to rail RL1, the drain of switch Q2 is connected to the source of switch Q3 and the drain of switch Q3 is connected to rail RL2. The control gates of switches Q2 and Q3 are connected to control circuit 140 in a manner to be further described. The half-bridge capacitors C8 and C9 are also connected in series across the rails RL1, RL2 and act as energy storage elements, and provide 150 V reference voltage for the network of the inductor L2 and the capacitor C7. The output of the half-bridge inverter, appearing across mid-points M1, M2, is a high frequency generally square wave signal.

The resonant output circuit 130 is of the LC type and includes the primary winding of inductor L2 connected in series with a starting capacitor C7 between the midpoints M1, M2. The resonant circuit is tuned to the third harmonic of the operating frequency. The discharge device 3 is connected at lamp terminals L1, L2, electrically in parallel with capacitor C7. The LC network provides a waveshaping and current limiting function to provide a lamp current to the discharge device 3 from the high frequency square wave inverter output present across the midpoints M1, M2.

The control circuit 140 controls the switching frequency and pulse width of the switches Q2, Q3 to provide the lamp current to discharge device 3 at a substantially constant frequency after lamp ignition. The heart of the control circuit is the 8 pin integrated circuit IC U1 (an IR 2151 from International Rectifier, for example). Pin 1 is the power input for IC U1. Pins 2 and 3 are coupled to a network which controls the inverter oscillation during steady-state operation as well as for providing ignition pulses to the discharge device 3. Pin 4 is connected to circuit ground. Pin 5 is connected to the control gate of switch Q3 via resistor R4. Pin 6 is connected to the midpoint M1 and provides the high side floating supply voltage. Pin 7 is connected to the control gate of switch Q2 via resistor R3. Pin 8 is connected to a node between the midpoint M1 and the drain of switch Q2 via a capacitor C6 and provides the high side supply voltage for switching switch Q2, and is charged via bootstrap diode D10 from the low voltage power supply.

The frequency of operation of the inverter is controlled at two different levels, which provides a soft-start feature for igniting the discharge device 3. The first and second levels are controlled by the switchable, soft start RC network of a resistor R2, a capacitor C5, a resistor R8 and a MOSFET switch Q4. When the switch Q4 is conductive, it shunts the resistor R8 so that the frequency is set at the second level by the RC time constant of the resistor R2 and capacitor C5. When the switch Q4 is non-conductive, the frequency is set at the first level by the RC time constant determined by the resistors R2, R8 in conjunction with capacitor C5. The switching of the switch Q4 is controlled by the network of a 7.5 V zener diode D9, a resistor R9 and the capacitor C13. The diode D9 has its cathode connected to the power supply line RL3 and its anode connected through the resistor R9 and the capacitor C13. The control gate of switch Q4 is connected to a node between the resistor R9 and the capacitor C13 via resistor R1 which dampens the turn-on of switch Q4.

During turn-on of the circuit an initial frequency is present—set by the resistors R2, R8 and capacitor C5—of around 28 kHz. This effectively detunes the network of L2 and C7 which has been tuned to the third harmonic (about 72 kHz) of the nominal operating frequency of about 24 kHz. Thus, the switches Q2 and Q3 are turned on into a non-resonant condition, and the current through these switches is significantly less than would be found at resonance. After approximately 10 ms, the charging time of diode D9, resistor R9 and capacitor C13, the switch Q4 is turned on and left on during steady state lamp operation. Switch Q4 shunts resistor R8, shifting the inverter frequency to the 24 kHz design range, which ignites the discharge device in a manner to be further described.

The integrated circuit IC U1 is powered by power supply 160 having two branches 160*a* and 160*b* providing a resistive startup at initial circuit turn on and a dv/dt supply providing power during operation, respectively. The branch 160*a* includes electrolytic capacitor C3, filter capacitor C4, and the resistors R1*a* and R1*b*. Capacitors C3 and C4 each have one end connected to circuit ground. The other end of capacitors C3, C4 are connected to rail RL1 via the parallel resistors R1*a*, R1*b* and to pin 1 of IC U1.

When line voltage is first applied to input terminals I1, I2, the electrolytic capacitor C3 is charged through parallel resistors R1*a*, R1*b* until the zener diode D9 turns on, at 7.5 V. The IC U1 will start switching at approximately 8.5 V. At this time capacitor C13 starts to charge via zener diode D9, and the soft start network is activated. The voltage across capacitor C13 increases until zener diode D4 conducts at 11 V. This now sets the supply voltage for operating IC U1. The zener diode D4 is in parallel with the capacitor C3 and clamps the voltage to which C3 charges to about 11 V, which appears at pin 1. During inverter oscillation, power is supplied to integrated circuit IC U1 by the dv/dt branch 160*b* which includes current-limiting capacitor C10 and rectifying diodes D5, D3. The capacitor C10 has one end coupled to the midpoint M1 and its other end connected to the cathode of a diode D5, the anode of which is connected to circuit ground. The diode D3 has its anode connected at a node between the capacitor C10 and the diode D5 and its cathode connected to the cathode of diode D4 and the capacitors C3, C4 and pin 1. The capacitor C10 limits the AC current from the square wave present at the midpoint M1, while the diodes D3, D5 rectify the AC voltage to DC for input at pin 1, clamped at around 11 V by the diode D4. The supply branch 160*a* is capable of supplying about 1.9 ma and the supply branch 160*b* is capable of supplying about 4 ma.

The stop circuit 150 provides a pulse ignition voltage for 50 ms. The stop circuit includes MOSFET switch Q1, having its source connected to ground and its drain connected to pin 1 and the capacitor C3 via resistor R10. When switch Q1 is conductive, the capacitor C3 is discharged to ground through the resistor R10, which turns the integrated circuit IC U1 off by removing the power supply. Switch Q1 is ultimately controlled by the presence of an over voltage on the secondary winding $L2_s$ of inductor L2. This may occur during generation of the ignition pulses if the discharge device does not ignite or if the discharge vessel extinguishes during inverter oscillation. An overvoltage across the secondary winding $L2_s$ causes the capacitor C11 to charge through the diode D6 and the resistor R5. When the capacitor C11 is charged to a range between about 26 and 32 V, the diac D7 breaks down, charging capacitor C12 to a voltage clamped by the diode D8 to 15 V, and rendering the switch Q1 conductive. Capacitor C12 discharges through the resistor R6, with the RC time constant of the resistor R6 and capacitor C12 controlling how long the switch Q1 remains conductive, and consequently how long the integrated circuit IC U1 remains off.

Figure 5A:
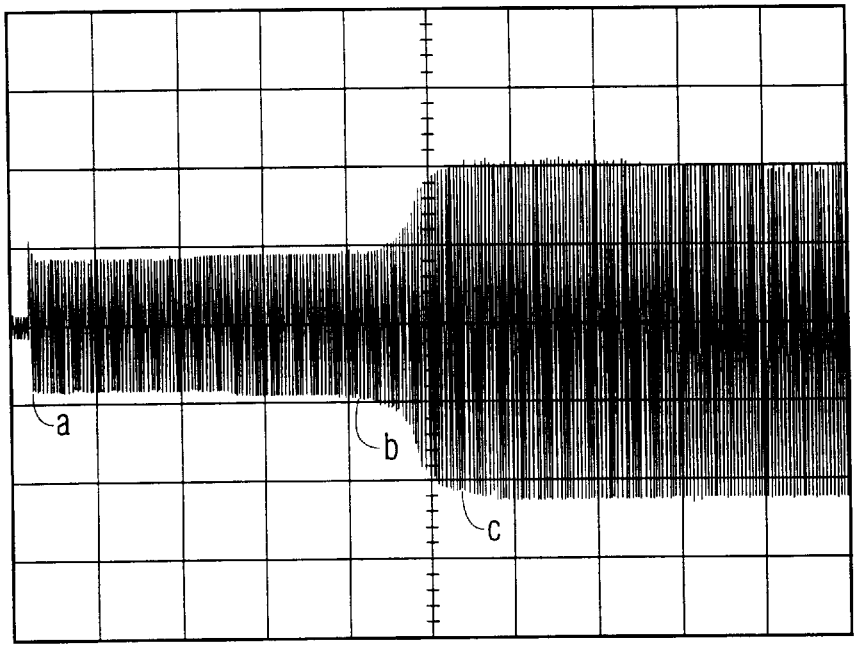
FIG. 5(*a*) illustrates a "soft start" feature of the ballast.
Figure 5B:
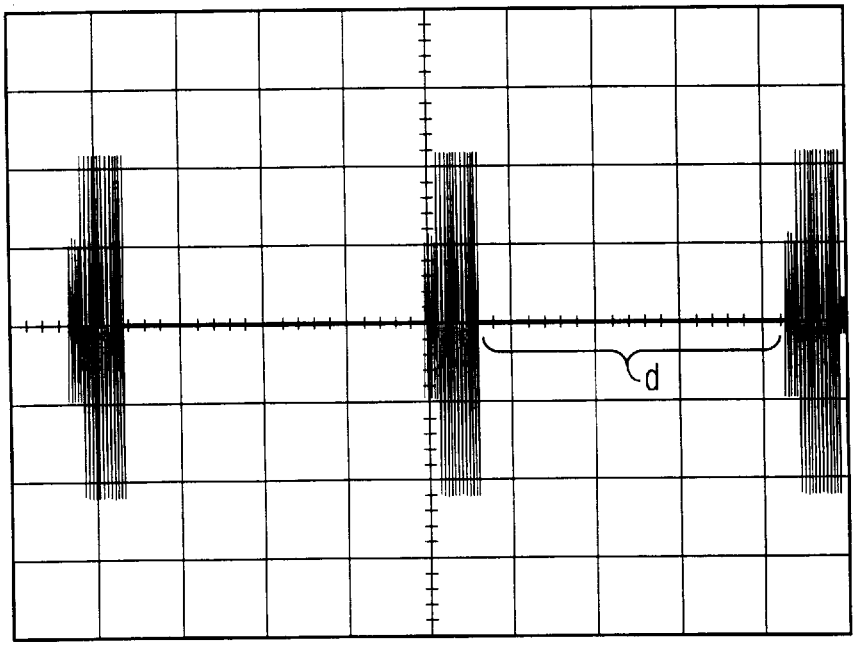
Figure 6A:
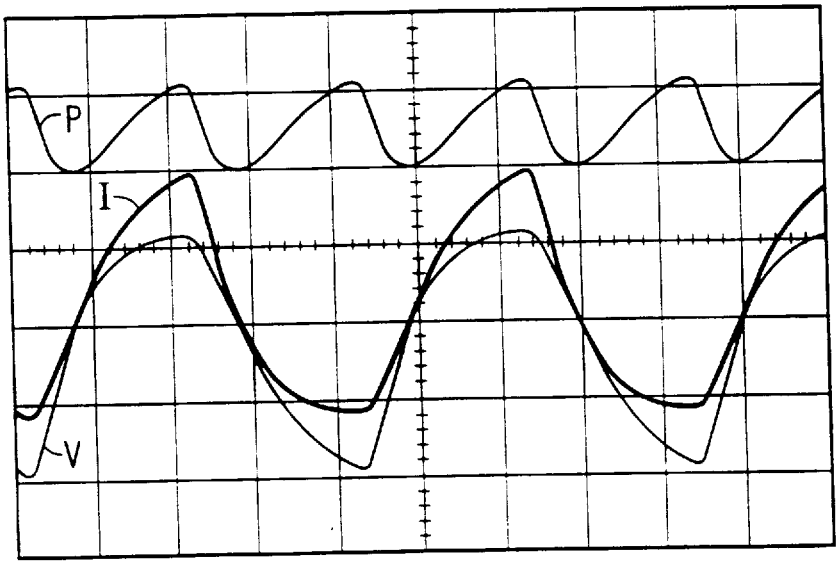
FIG. 6(*a*) illustrates the steady-state lamp power, current and voltage waveforms.
Figure 6B:
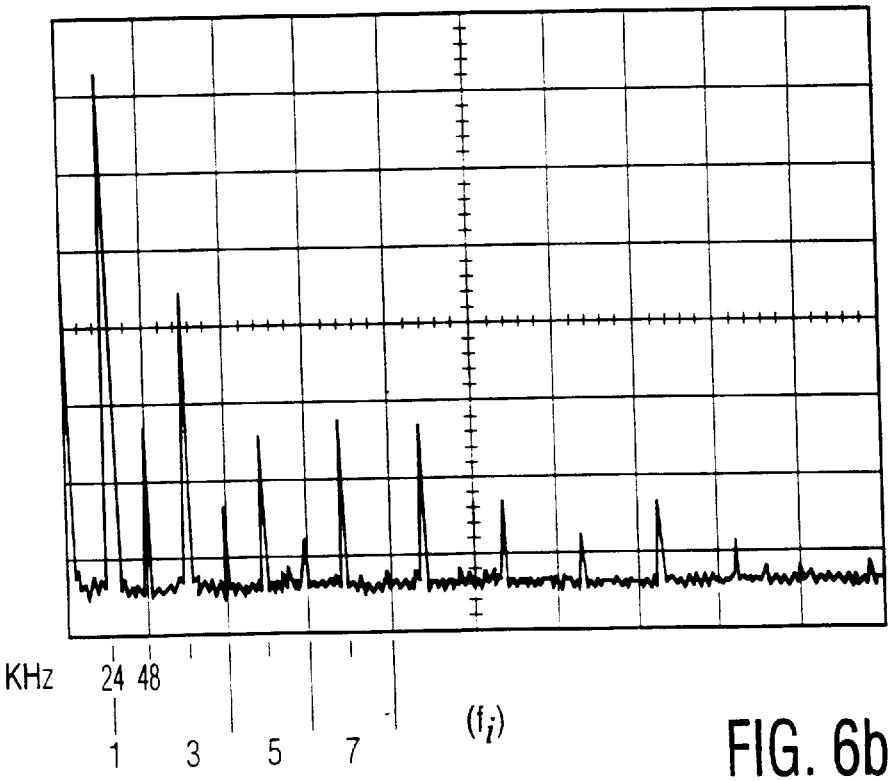
Figure 6C:
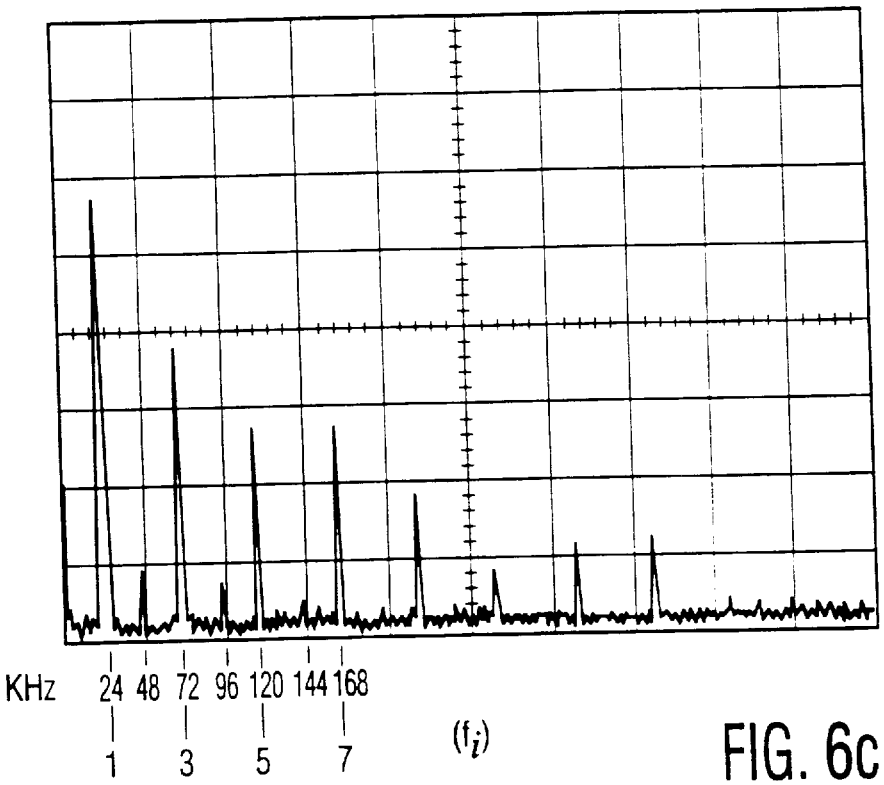
Figure 6D:
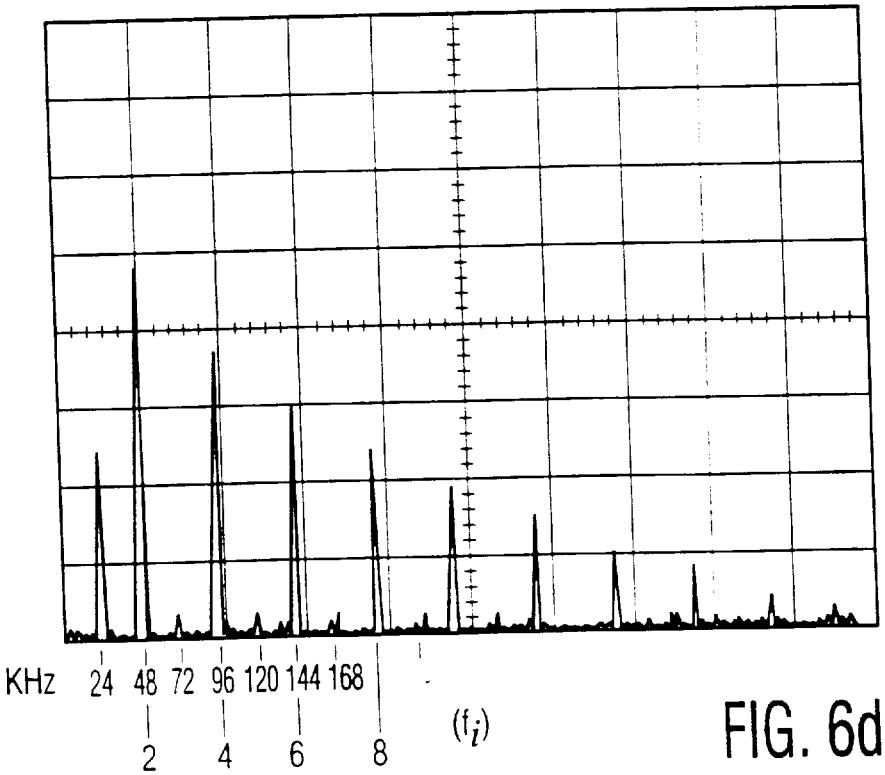

The soft start and recurrent ignition features are illustrated in FIGS. 5(*a*) and (*b*). Each ignition pulse sequence starts at an initial voltage of about 400 V peak (ref. "a") and ramps up to a 1200 V peak ignition voltage (ref. "c") for igniting the discharge lamp. The initial voltage is generated when the inverter frequency is at 28 kHz. This state occurs for about 10 ms, until R9 and C13 are charged to the threshold voltage of switch Q4, in this case about 2 V. The switch Q4 takes a finite time, set by the resistor R9 and the capacitor C13 to turn fully on. During this finite time, the resistor R8 is gradually shunted, causing a gradual reduction from the initial 28 kHz frequency to the nominal 24 kHz frequency over a time period of about 40 ms. This frequency shift provides the soft ramp-up in voltage denoted by ref. "b". The nominal 24 kHz provides the 1200 V peak ignition voltage.

After about 50 ms at 1200 V peak, the time constant of resistor R5 and capacitor C1 causes diac D7 to breakdown, the stop circuit 150 turns the IC U1 off, stopping the ignition pulses (ref "d"). After approximately 400 ms (ref "c"), the resistor R6 discharges capacitor C12, opening switch Q1. This returns power to the IC U1 via resistive supply branch 160*a*, beginning the ignition pulse sequence again. (FIG. 5(*b*) Consequently, the circuit provides a soft start as well as recurrent ignition pulse sequences.

FIG. 6(*a*) shows the steady state waveforms for the lamp power (P), current (I) and voltage (V) for the above 20 W discharge device operated on the above described ballast. FIGS. 6(*b*), 6(*c*) and 6(*d*) are fast fourier transforms illustrating the harmonic content of the lamp voltage, current and power waveforms of FIG. 6(*a*), respectively. In these FIGS. 6(*b*)–(*d*), the scale for each vertical division is 10 dB. The fourier equations for the lamp voltage, current and power are:

$$V(t)=V_1 \cos(2\pi f_1 t)+V_3(\cos 2\pi f_3 t)+V_i(\cos \pi 2 f_i t)+\ldots;$$

$$I(t)=I_1 \cos(2\pi f_1 t)+I_3(\cos 2\pi f_3 t)+I_i(\cos \pi 2 f_i t)+\ldots;$$

and $$P(t)=V(t)*I(t)$$

where the subscript 1 represents the fundamental of the voltage and current and the subscripts 3 and i represent the third and odd $i^{th}$ harmonic, respectively, of the voltage and current.

After multiplying and simplifying, the power equation becomes:

$$P(t)=A+B\cos(2\pi(2f_1)t)+C\cos(2\pi(4f_1)t)+D\cos(2\pi(6f_i)t)\ldots;$$

Thus, the lamp power has a fundamental at twice the fundamental frequency of the lamp current and voltage, and harmonics at 4,6,8 etc. times the fundamental frequency of the lamp current and voltage. This is clearly shown in FIG. 6 (d) in which the fundamental of the power frequency, in this case 48 kHz, is twice the frequency of the fundamental of the lamp current and voltage, in this case 24 kHz. The third harmonic of the current waveform at 72 kHz, was only 11%–12% of the 24 kHz fundamental frequency. The first harmonic of the power frequency is at 96 kHz but is only about 10% of the magnitude of the fundamental power frequency. With these levels of harmonics in the current and power waveforms, no acoustic resonance was observed. Thus, the disclosed circuit and discharge device show that it is possible to drive an HID discharge device with a signal which differs substantially from a pure sinusoidal waveform while avoiding acoustic resonance. Those of ordinary skill in the art will appreciate that other circuits with a more closely sinusoidal lamp current and voltage are possible, which will have lower harmonic content and also be suitable for driving the discharge device at a frequency below the lowest lamp resonant frequency. Such a more closely sinusoidal waveform may be provided by a push-pull circuit, known for example from U.S. Pat. Nos. 4,484,108 and 4,463,286.

Lamp Efficacy; Photometrics

The above described PAR 38 embodiment has a system wattage of 22 W, with the lamp consuming about 20 W and the ballast having losses of about 2 W. Table 1 compares the photometric parameters of this lamp (INV.) with that of a commercially available 90 W Halogen PAR 38 and a 60 W PAR 38 with a halogen IR burner. The data for the above-described lamps according to the invention were based on a group of 20 samples. The light emitted by the sample lamps had correlated color temperature (CCT) of 3000° K and a color rendering index (CRI) of >85. The luminous efficacy of the lamp was 60 LPW. As compared to the known 60 W PAR 38 lamp with a halogen IR burner, the luminous efficacy was 233% better, and 314% better with respect to the 90 W halogen PAR 38. Additionally, the discharge device is expected to have a life of about 10,000 hours, which is 3 to 4 times that of the known 60 W halogen IR and 90 W halogen PAR 38 lamps.

TABLE I

| LAMP | POWER (W) | LUMENS | EFFI-CACY (LPW) | MBCP, SPREAD (Flood) (cd), Degrees | CCT K. | CRI |
|---|---|---|---|---|---|---|
| INV. | 22 | 1320 | 60 | 4000, 28 | 3000 | 85–87 |
| 90 W | 90 | 1280 | 14.5 | 4500, 28 | 2900 | 100 |
| 60 W IR | 60 | 1100 | 18 | 3650, 29 | 2800 | 95 |

Accordingly, it is clear that the integrated lamp is superior to the commercially available halogen and halogen IR lamps with respect to life and luminous efficacy.

Additionally, by altering the fill of the discharge device with known metal halide technology, the lamp designer has greater control over the photometric parameters as compared to a lamp generating light with an incandescent filament, in particular with respect to the correlated color temperature.

A significant advantage of the use of a metal halide discharge device with a ceramic wall, and at low wattages, is the significant colorimetric uniformity (a) relative to burning position and (b) from lamp-to-lamp. This uniformity is believed to be due to the small physical size which leads to more uniform thermal properties in the lamp fill during operation and the tight dimensional tolerances to which the ceramic material can be held during high speed manufacturing, which provides the lamp-to-lamp uniformity. It has been found that ceramic discharge vessel dimensions can be held to better than 1% (six sigma) whereas for conventional quartz arc tube technology the dimensions can only be held to about 10%.

Figure 7A:
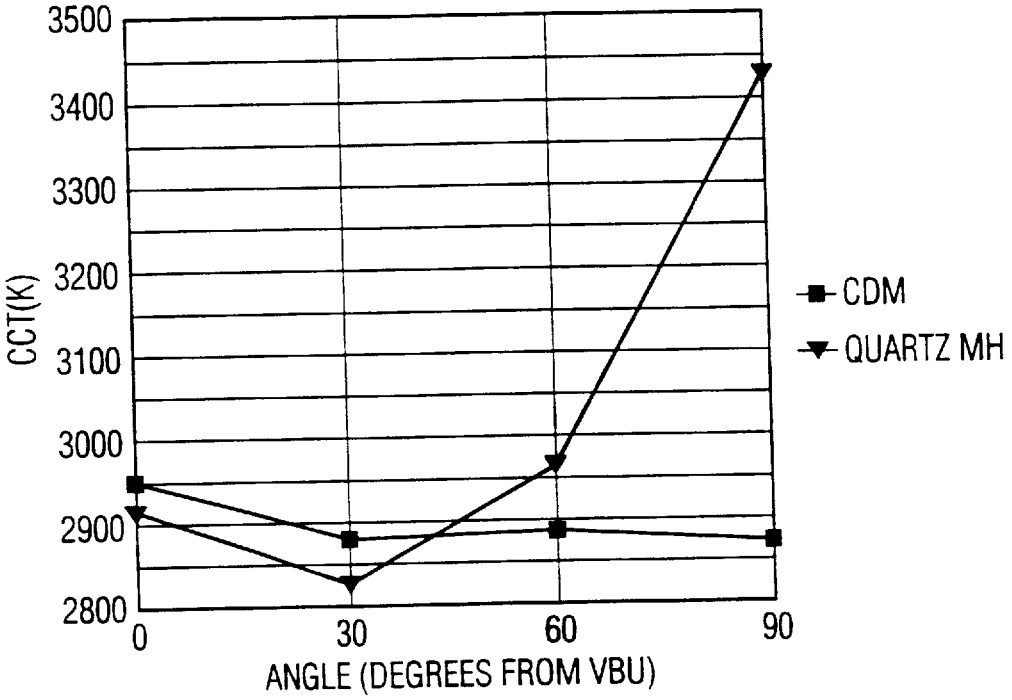
FIGS. 7(*a*) and 7(*b*) are graphs illustrating the superior stability in color correlated temperature (CCT) and color rendering (CRI) of a metal halide lamp with a ceramic discharge vessel versus a quartz discharge vessel.
Figure 7B:
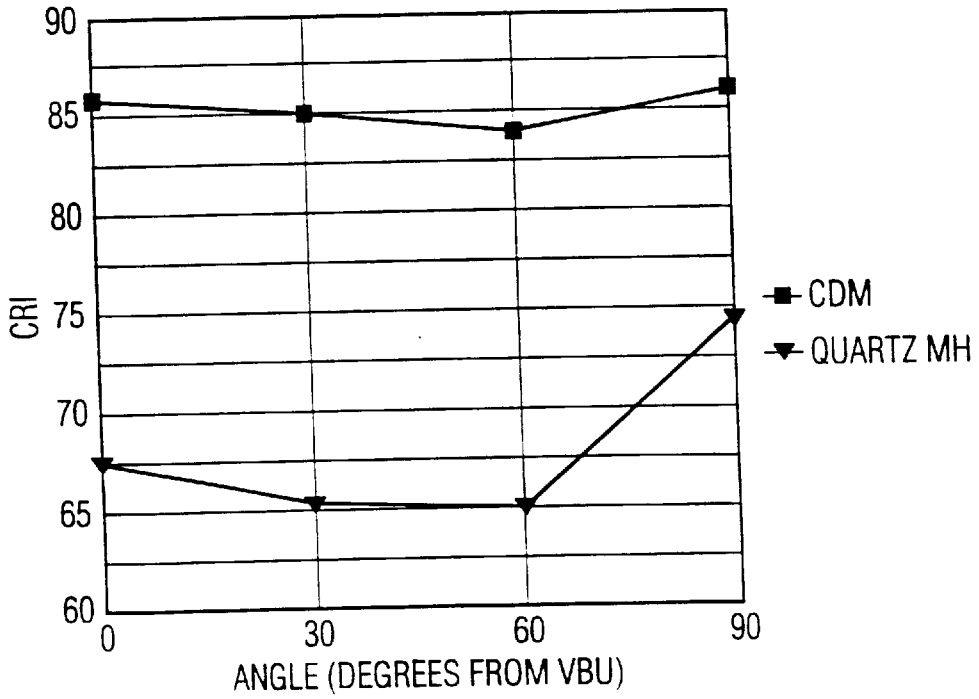

FIGS. 7(*a*) and 7(*b*) are graphs of CCT and CRI, respectively, for a typical ceramic metal halide (CDM) lamp and a typical quartz metal halide lamp as a function of burning position, indicated as degrees from the vertical, base up (VBU) burning position. For CCT, the CDM lamp had only a variation of 75 K versus a variation of about 600 K for the quartz lamp, over the range 0–90 degrees from VBU. Likewise, for CRI, the CDM lamp had a variation of only about 2.5 CRI versus about 10 CRI for the quartz metal halide lamp.

Additionally, with respect to lamp-to-lamp color stability, a low wattage metal halide with a ceramic discharge vessel typically exhibits a standard deviation of 30 K in color temperature. For low wattage metal halide lamps with quartz arc tubes, the standard deviation is much greater, typically 150–300 K. The much narrower spread in color temperature is important because it makes a lamp system with the ceramic metal halide discharge device an acceptable replacement for halogen PAR lamps for indoor and retail lighting. In effect, when many reflector lamps with the ceramic discharge device are used, for example in a ceiling, they will appear to be substantially uniform, unlike quartz metal halide lamps in which the observer would clearly notice the non-uniformity among the lamps.

Figure 8:
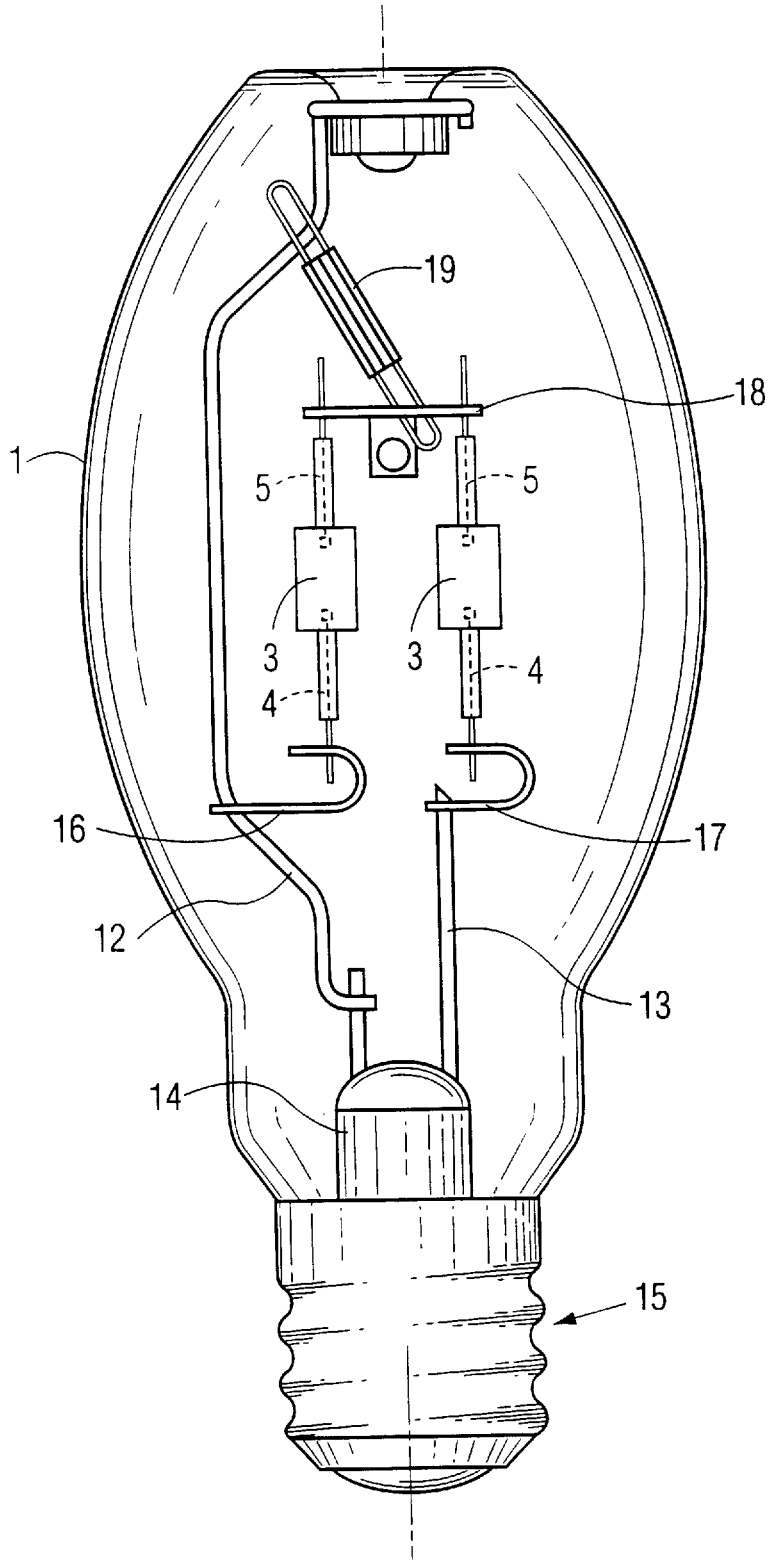
FIG. 8 illustrates an HID lamp having a plurality of discharge devices according to FIG. 2 within a common outer lamp envelope, connected electrically in series.

FIG. 8 shows a metal halide high pressure discharge lamp with first and second discharge devices 3 connected electrically in series within a common outer bulb 1. The discharge devices are the same as illustrated in FIG. 2, are nominally identical, and include the starting aid 260 of FIG. 1.

A conductive frame supports the discharge devices within the outer lamp envelope. The frame includes first and second conductive support rods 12, 13 extending from the lamp stem 14, each connected to a respective lamp contact on the lamp base 15. Respective C-shaped connectors 16, 17 electrically connect each of the first electrode assemblies 4 to a respective first and second support rod 12, 13, and consequently to a source of electric potential provided on the contacts at the lamp base 15. The second electrode assemblies 5 are connected in series via conductive cross member 18. An insulative support 19 is connected between the cross member 18 and the upper end of the support rod 12 to provide further mechanical support to the discharge vessels.

A lamp with two discharge devices in series as in FIG. 8 was ignited and operated with the above-described ballast according to FIGS. 3, 4. With two arc tubes operated concurrently, the lamp provides approximately twice the light output. Each arc tube has its lowest resonant frequency at 30 kHz, so with the ballast providing lamp current at a nominal 24 kHz, there is no danger of inducing acoustic resonance. It should be noted that a single discharge device having a rated wattage of 40 W, the same as the two 20 W discharge devices, would have its lowest lamp resonant frequency significantly lower than that for each of the two 20 W arc tubes, either much closer to 19 kHz or below 19 kHz. Accordingly, by using two discharge devices the large resonance free operating window above about 19 kHz is retained while the benefit of more light output of a higher wattage lamp is obtained. While two arc tubes are shown, concurrent operation of more than two discharge devices is possible, so long as the circuit is modified to provide the correct voltage for igniting and operating the lamps. Other ignition aids, such as a well known UV enhancer, may alternatively be incorporated in the lamp to improve ignition characteristics.

While there has been shown what is considered by the inventors to be the preferred embodiments of the invention, those of ordinary skill in the art will appreciate that various modifications may be made to the above described lamp which are within the scope of the appended claims. For example, while a discharge device with electrodes has been shown, the benefits regarding discharge device size, material, and shape with respect to acoustic resonance would be applicable to an electrodeless lamp. Accordingly, the specification is considered to be illustrative only and not limiting.

We claim:

1. A high frequency, high pressure discharge lamp system, comprising:

a high pressure discharge lamp comprising a discharge device sealed in a gas-tight manner and enclosing a discharge space, a discharge sustaining filling, and means for maintaining a discharge within said discharge space during lamp operation; and a ballast circuit coupleable to said discharge device for energizing said discharge lamp to maintain a gas discharge within said discharge space, characterized in that:

the discharge device during normal lamp operation is free of acoustic resonances at alternating lamp currents below a lowest lamp resonant frequency, the ballast circuit energizes the discharge lamp so as to have an alternating lamp current having a fundamental frequency and harmonics which are integral multiples of the fundamental frequency, the lamp resonant frequency being greater than about 19 kHz, the fundamental frequency during nominal lamp operation being maintained only in a window between (i) about 19 kHz and (ii) below the lowest lamp resonant frequency, and the harmonics above the lowest lamp resonant frequency have amplitudes which are insufficient to induce acoustic resonance.

2. A lamp system according to claim 1, wherein said ballast maintains said fundamental frequency substantially constant during lamp operation.

3. A lamp system according to claim 2, wherein said discharge vessel comprises a ceramic and includes a central cylindrical zone with end walls, said end walls being spaced by an axial distance "L" and said central zone having an inner diameter "ID", and the ratio L:ID is about 1:1.

4. A lamp system according to claim 3, wherein said discharge lamp is a metal halide lamp and said discharge sustaining filling includes a buffer, a rare gas and a metal halide.

5. A lamp system according to claim 4, wherein said discharge lamp comprises an outer lamp envelope and a plurality of said discharge devices within said lamp envelope each energized by said ballast circuit to concurrently emit light.

6. A lamp system according to claim 2, wherein said discharge lamp is a metal halide lamp and said discharge sustaining filling includes a buffer, a rare gas and a metal halide.

7. A lamp system according to claim 2, wherein said discharge lamp comprises a lamp envelope and a plurality of said discharge devices within said lamp envelope each energized by said ballast circuit to concurrently emit light.

8. A lamp system according to claim 1, wherein said discharge lamp is a metal halide lamp and said discharge sustaining filling includes a buffer, a rare gas and a metal halide.

9. A lamp system according to claim 1, wherein said discharge lamp comprises a lamp envelope and a plurality of said discharge devices within said lamp envelope each energized by said ballast to concurrently emit light.

10. A lamp system according to claim 1, further comprising a housing enclosing said ballast circuit and an outer lamp envelope enclosing said discharge device, said housing and said envelope forming an integral structure.

11. A lamp system according to claim 1, wherein said housing includes a screw base for being received by a screw-type socket, said screw base having base contacts connected to said ballast circuit for supplying electric power to said ballast when said base is received in a screw-type socket connected to an electric utility line voltage.

12. A high frequency metal halide lamp system, comprising:

a) a metal halide lamp comprising a ceramic discharge vessel sealed in a gas-tight manner and enclosing a discharge space, a discharge sustaining filling within said discharge space including mercury, a metal halide, and a rare gas, a pair of discharge electrodes within said discharge space between which a gas discharge is maintained during lamp operation, and current conductors extending from said discharge electrodes to the exterior of said discharge vessel; and b) a ballast circuit connected to said metal halide lamp for igniting and maintaining a gas discharge between said discharge electrodes, characterized in that:

the discharge lamp during normal lamp operation is free of acoustic resonances at alternating lamp currents below a lowest lamp resonant frequency, the ballast circuit energizes the discharge lamp so as to have an alternating lamp current having a fundamental frequency and harmonics which are integral multiples of the fundamental frequency, the lowest lamp resonant frequency being greater than about 19 kHz, the fundamental frequency during nominal lamp operation being maintained only in a window between (i) about 19 kHz and (ii) below the lowest lamp resonant frequency, and the harmonics above the lowest lamp resonant frequency have amplitudes which are insufficient to induce acoustic resonance.

13. A lamp system according to claim 12, wherein said discharge space enclosed by said discharge vessel is circular cylindrical between said electrodes and has planar end walls.

14. A lamp system according to claim 13, wherein said end walls are spaced by an axial distance "L" and said central zone has an inner diameter "ID", and the ratio L:ID is about 1:1.

15. A lamp system according to claim 14, wherein said ballast maintains said fundamental frequency substantially constant during lamp operation.

16. A lamp system according to claim 15, wherein said discharge lamp comprises a lamp envelope and a plurality of said discharge devices within said lamp envelope each energized by said ballast circuit to concurrently emit light.

17. A lamp system according to claim 14, wherein said discharge lamp comprises a lamp envelope and a plurality of said discharge devices within said lamp envelope each energized by said ballast circuit to concurrently emit light.

18. A lamp system according to claim 13, wherein said ballast maintains said fundamental frequency substantially constant during lamp operation.

19. A lamp system according to claim 13, wherein said discharge lamp comprises a lamp envelope and a plurality of said discharge devices within said lamp envelope each energized by said ballast circuit to concurrently emit light.

20. A lamp system according to claim 12, wherein said ballast maintains said fundamental frequency substantially constant during lamp operation.

21. A lamp system according to claim 12, wherein said discharge lamp comprises a lamp envelope and a plurality of said discharge devices within said lamp envelope each energized by said ballast circuit to concurrently emit light.

22. A high frequency, high pressure discharge lamp system, comprising:

a high pressure discharge lamp comprising a discharge device sealed in a gas-tight manner and enclosing a discharge space, a discharge sustaining filling, and means for maintaining a discharge within said discharge space during lamp operation; and a ballast circuit coupleable to said discharge device for energizing said discharge device to maintain a gas discharge within said discharge space, characterized in that:

the discharge device during normal lamp operation is free of acoustic resonances at lamp power frequencies below a lowest lamp resonant power frequency, the ballast circuit energizes the discharge lamp so as to have a fundamental power frequency and harmonics which are integral multiples of the fundamental power frequency, the lowest lamp resonant power frequency being greater than about 38 kHz, the fundamental power frequency being maintained during nominal operation in a window between (i) about 38 kHz and (ii) below the lowest lamp resonant power frequency, and the harmonics above the lowest lamp resonant power frequency have amplitudes which are insufficient to induce acoustic resonance.

23. A high frequency metal halide lamp system according to claim 12, further comprising a starting aid for said discharge device, said starting aid comprising a length of conductive material extending from one said current conductor to the area of the other said current conductor and terminating adjacent the discharge vessel wall of the other said current conductor, said discharge vessel wall of the said other current conductor enclosing a narrow gap with the said other current conductor in which said discharge sustaining fill is present.

* * * * *